United States Patent [19]

Day

[11] Patent Number: 4,967,112

[45] Date of Patent: Oct. 30, 1990

[54] ELECTRICAL POWER CELL ENERGIZED BY HIGH FREQUENCY ELECTROMAGNETIC RADIATION

[76] Inventor: John J. Day, 911 NW. 42nd Ave., Coconut Creek, Fla. 33066

[21] Appl. No.: 476,783

[22] Filed: Feb. 8, 1990

[51] Int. Cl.[5] ..... G21D 7/00

[52] U.S. Cl. ..... 310/304; 136/253; 429/5

[58] Field of Search ..... 310/304; 136/253; 429/5

[56] References Cited

U.S. PATENT DOCUMENTS

| | | | |
|---|---|---|---|
| 3,122,640 | 2/1964 | Gross | 250/83.3 |
| 3,591,860 | 7/1971 | Sampson | 310/2 |
| 4,178,524 | 1/1979 | Ritter | 310/304 |
| 4,663,115 | 5/1987 | Russell | 310/304 |

OTHER PUBLICATIONS

LeVent et al., "Fully Encapsulated . . . Reactor Measurements"; Ntis, Conf-791037-18; IEEE Nuc. Sci. Symp., 10/17/79.

Campos, C. J. S.; "Compton Current Detector"; Ntis DE87703452/xab, Sao Paulo Univ., Brazil.

*Primary Examiner*—Nelson Moskowitz

*Attorney, Agent, or Firm*—Oltman and Flynn

[57] ABSTRACT

A power cell for generating useful electrical power from high frequency electromagnetic radiation comprising a spiral-wound, multi-layer film forming a cylindrical body with a central opening for receiving the radiation source. The film has in succession a conductive grounded emitter layer, a first intermediate layer of dielectric material, a second intermediate layer of a material having a substantial Compton effect, a conductive collector layer, a third intermediate layer of the same dielectric material, a conductive retarding layer, and an insulating layer. The collector and emitter layers are to be connected to the opposite terminals of a load. A bleeder regulator is connected between the retarding and collector layers to pass excess charge on the retarding layer to the collector layer.

9 Claims, 1 Drawing Sheet

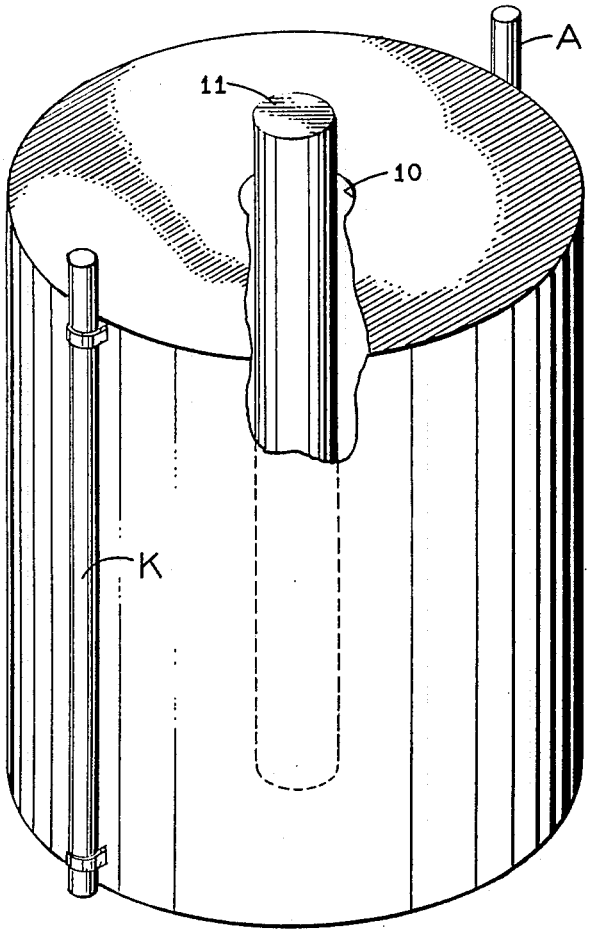
FIG. 1
FIG. 2
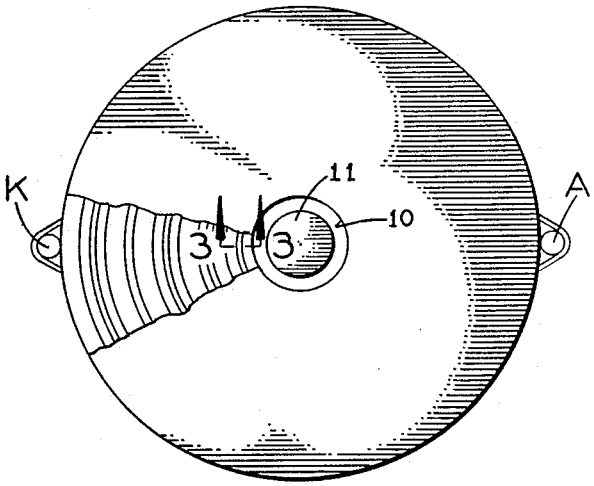
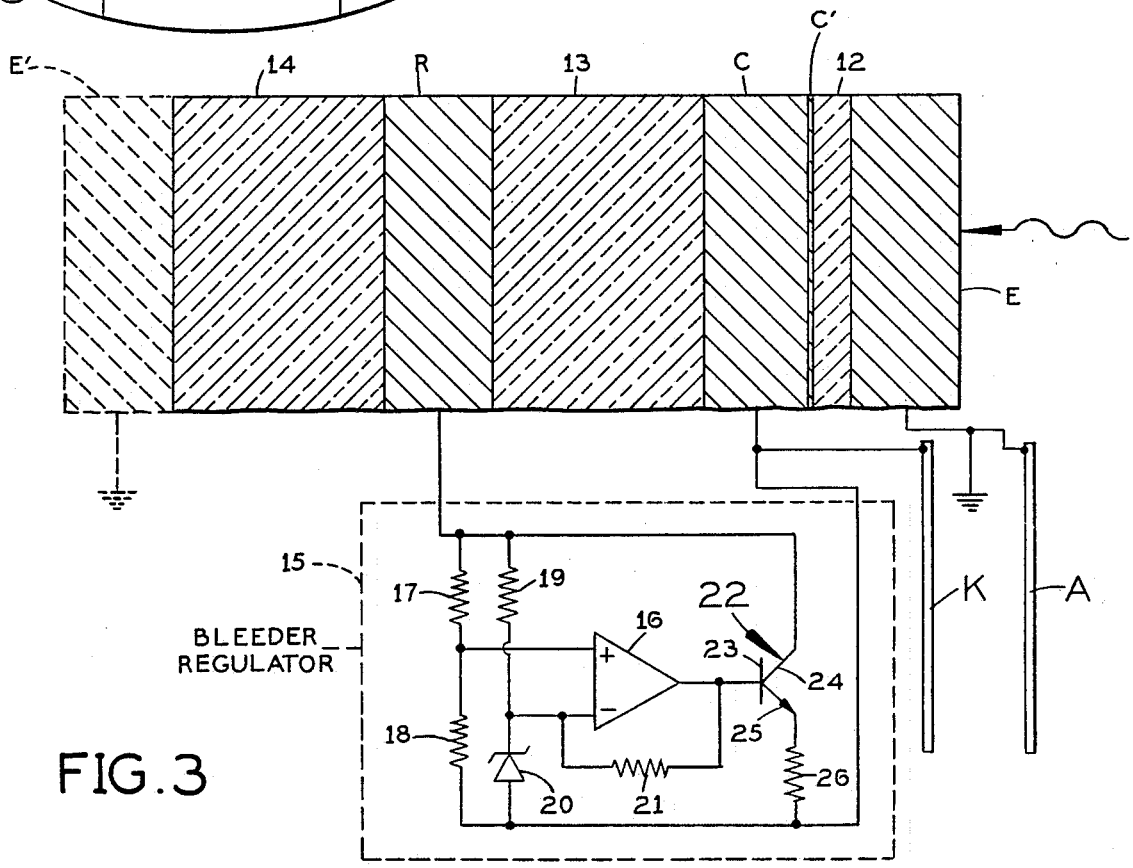
FIG. 3

ELECTRICAL POWER CELL ENERGIZED BY HIGH FREQUENCY ELECTROMAGNETIC RADIATION

SUMMARY OF THE INVENTION

This invention relates to a power cell for converting high frequency electromagnetic radiation, such as gamma radiation, into useful electrical power at high voltage and reasonably high current.

One particular use of the present invention is to produce useful electrical power from the high frequency electromagnetic gamma radiation emitted by a spent fuel rod from a nuclear reactor.

High frequency electromagnetic radiation is not bent in electric or magnetic fields. It travels with the velocity of light and can eject photoelectrons from a wide variety of materials which act as absorbers. Any particular photon in the high frequency electromagnetic radiation retains all of its energy, except for a relatively small amount lost in the scattering process, until it ejects a high speed photoelectron from some atom in the absorber. The photon then gives up its entire energy to this photoelectron and ceases to exist.

A power cell in accordance with the present invention is a thin multi-layer film having an absorber in the form of a thin, emitter layer of electrically conductive material separated from a similar electrically conductive collector layer by a dielectric first insulating layer having a thickness within the range from substantially 50 Angstroms to 500 microns and a thinner second intermediate layer of a different material having a substantial Compton effect. The direction of the electromagnetic radiation is through the emitter layer and then through the dielectric layer and the Compton effect layer to the collector layer. Photoelectrons released by the emitter layer move generally in the same direction as the electromagnetic radiation, i.e., from the emitter layer through the intermediate layers to the collector layer. In passing through the intermediate layers the photoelectrons experience ionizing collisions which cause the photoelectrons to lose energy and release from secondary Compton electrons from both intermediate layers but especially from the Compton effect layer and effect a corresponding "Compton shift, producing secondary electromagnetic radiation of longer and less energetic wavelength. The photoelectrons and secondary Compton electrons deposit their negative charges on the collector layer and thereby produce an electrostatic field between the collector and emitter layers that opposes the movement of electrons toward the collector layer. Consequently, the photoelectrons and the secondary Compton electrons will have lost substantially all their kinetic energy when they reach the collector layer. The collector and emitter layers are connected across an electrical load which withdraws excess charge on the collector layer.

Preferably the present invention also has an electrically conductive retarding layer on the opposite side of the collector layer from the emitter layer. Sandwiched between the collector and retarding layers is a third intermediate layer of dielectric material having a thickness within the 50 Angstroms -500 microns range but substantially thicker than the dielectric first intermediate layer between the emitter and collector electrodes. In the third intermediate layer between the collector and retarding layers photoelectrons from the collector layer have ionizing collisions that release secondary Compton electrons from the dielectric material. These secondary Compton electrons and the photoelectrons from the collector layer that produce them deposit their charges on the retarding layer, producing an electrostatic field between the retarding and collector layers that opposes the movement of these photoelectrons and secondary Compton electrons toward the retarding layer and thereby causes these electrons to have lost most of their kinetic energy by the time they impringe on the retarding layer. A bleeder regulator is connected across the retarding and collector layers to regulate the voltage difference between them and bleed off excess charge on the retarding layer to the load connected to the collector layer.

A principal object of this invention is to provide a novel power cell for converting high frequency electromagnetic energy into usable electrical power.

Another object of this invention is to provide such a power cell which is adapted to use a spent fuel rod from a nuclear reactor as its source of high frequency electromagnetic energy.

Another object of this invention is to provide a novel power cell of thin multi-layer film construction with conductive and insulating layers in alternating sequence in the path of high frequency electromagnetic radiation from an energy source and with each insulating having a thickness in that direction substantially within the range from 50 Angstroms to 500 microns, enabling secondary Compton electrons produced by ionizing collisions in this layer to deposit their charges on an adjoining conductive layer.

Another object of this invention is to provide such a power cell assembly having a cell which is a generally cylindrical body made up of a spiral-wound multi-layer film having its successive layers in sequence radially of the cylinder, and an external circuit for maintaining different conductive layers of each film at different voltages and for drawing off electrical power as a result of the flow of photoelectrons and secondary Compton electrons in the cell.

Further objects and advantages of this invention will be apparent from the following detailed description of a presently-preferred embodiment shown schematically in the accompanying drawings.

DESCRIPTION OF THE DRAWINGS

FIG. 1 is a perspective view of a power cell in accordance with the present invention, partly broken open, using a spent fuel rod from a nuclear reactor as the energy source;

FIG. 2 is a top plan view of the power cell and fuel rod shown in FIG. 1; and

FIG. 3 is an enlarged cross-section through the innermost turn of the multi-layer film in the power cell, as indicated by the section line 3—3 in FIG. 2, and showing the bleeder regulator and the anode and cathode on the outside of the power cell.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Referring first to FIGS. 1 and 2, in broad outline the present power cell is a generally cylindrical structure having a central longitudinal opening 10 which receives in high frequency electromagnetic radiation source in the form of a spent fuel rod 11 from a nuclear reactor. The power cell is composed of a spiral-wound multi-layer film having a thickness of about 1 mm., for example. In one practical embodiment, the power cell has an outside diameter of 24 cm., an inside diameter of 4 cm., and a height of 30.5 cm., and it has 100 or so turns of a spiral-wound multi-layer film having its successive turns in contiguous relationship.

Referring to FIG. 3, the innermost turn of the multi-layer film of the power cell has, from the inside out: an emitter layer E in the form of an aluminum film which is 127 microns thick, a first intermediate layer 12 of glass which is 51 microns thick, an aluminum film collector layer C which is 127 microns thick, and on the side toward layer 12 has a much thinner coating C′ of a material that emits Compton electrons, coating C′ being a second intermediate layer of the film, a third intermediate layer 13 of glass which is 254 microns thick, an aluminum film retarding layer R which is 127 microns thick, and a glass outer insulation layer 14 which is 254 microns thick. Preferably, the Compton effect layer C′ has a thickness of 50–100 Angstroms. The emitter layer E′ in the next turn of the film outward in the cell is shown in phantom in FIG. 3 engaging the outer face of the outer insulation layer 14 of the innermost turn.

In each turn of the film, the emitter layer E is a first electrically conductive layer, the collector layer C is a second electrically conductive layer, the retarding layer R is a third electrically conductive layer, the first and third intermediate layers 12 and 13 have a substantial insulating effect, the second intermediate layer C′ has a substantial Compton effect, and the outer layer 14 insulates the retarding layer R from the emitter layer in the next turn outward. Preferably, layers 12, 13 and 14 are of the same dielectric material, such as glass. The emitter layer in each turn of the film is connected conductively to an external anode A, which is grounded. The collector layer C in each turn of the film is connected to an external cathode K. The electrical load that is to be energized by this power cell is connected across the anode A and cathode K.

If desired, the emitter layer E, the collector layer C or the retarding layer R, or any two of them or all three may have a thin coating or coatings, like the coating C′ shown on collector layer C, of a different material, such as selenium, lead, copper or silver, etc. to modify the emission, collection or retarding performance of that layer.

The optimum thickness of each electrically conductive layer E, C and R depends upon the radiation source. The intensity of the electromagnetic radiation of a give wavelength decreases exponentially as it passes through an absorber like each of these layers. Therefore, the thickness of each of these layers is selected to match the radiation characteristics of the source 11. This is also true of the one or more Compton effect layers like the layer C′ in the cell.

Instead of glass, each insulation layer 12, 13 and 14 may be of "Lucite" or other suitable plastic or ceramic, or it may be of certain metals, depending upon the temperature at which the power cell operates.

The essential requirement of coating C′ is that it release a relatively large number of secondary Compton electrons as a result of the photoelectrons passing through it.

The retarding layer R will be at a relatively high negative voltage, such as −3000 volts, depending upon the thickness of the first and second intermediate layers 12 and 13. The greater the thickness of the insulation layer between two successive conducting layers, the greater will be the voltage difference between them in response to a particular electromagnetic radiation. The collector layer is kept at about −440 volts through a bleeder regulator 15 (FIG. 3) connected between it and the retarding layer R.

The regulator 15 has an operational amplifier 16 with its positive input terminal connected through a resistor 17 to the retarding layer R of each turn of the film and through a resistor 18 to the collector layer C of each turn of the film. Resistors 17 and 18 constitute a voltage divider for applying to the positive input terminal of amplifier 16 an input voltage that is proportional to the voltage difference between layers R and C. The negative input terminal of amplifier 16 is connected through a resistor 19 to the retarding layer R and through a Zener diode 20 to the collector layer C. A feedback resistor 21 is connected between the negative input terminal and the output terminal of amplifier 16. A shunt transistor 22 has its base electrode 23 connected to the output terminal of amplifier 16, its collector electrode 24 connected to the retarding layer R, and its emitter electrode connected through a resistor 26 to the collector layer C.

In the operation of the bleeder regulator, the Zener diode 20 provides a fixed reference potential on the negative input terminal of operational amplifier 16 while the voltage divider 17, 18 provides on the positive input terminal of amplifier 16 a voltage which is proportional to the voltage difference between retarding layer R and collector layer C. The operational amplifier produces an error signal on its output terminal that controls the rate of current discharge from retarding layer R through shunt transistor 22 and resistor 26 to the collector layer C.

In the operation of this power cell, the emitter layer E in the turn of the film closest to the source 11 of high frequency electromagnetic radiation acts as an absorber in which some of the radiation photons cease to exist and photoelectrons are emitted generally in the same direction as the electromagnetic radiation, i.e., toward the collector layer C in this turn of the film. To some extent in the insulation layer 12 next to the first emitter layer E and to a much greater extent in the second intermediate layer C′, photoelectrons from layer E undergo ionizing collisions and release lower energy secondary Compton electrons which move generally in the same direction as the photoelectrons (and the electromagnetic radiation). The adjoining collector layer C receives the negative charges of the photoelectrons from emitter layer E and the lower energy secondary Compton electrons. Collector layer C also acts as an absorber of some of the high frequency electromagnetic radiation from source 11 which reaches it without having been absorbed by the first emitter layer E. As a radiation absorber, collector C emits photoelectrons which move through the insulating layer 13 to the retarding layer R and in doing so cause lower energy secondary Compton electrons to be released which also move to the retarding layer. The primary function of the outer insulating layer 14 is to insulate the retardng layer R in that turn of the film from the emitter layer E in the next turn.

Essentially, the same process takes place in each successive turn of the multi-layer film outward from the turn E-12-C'-C-13-R-14 closest to the radiation source 11. Only a very small percentage of the photons of electromagnetic radiation energy is absorbed in each turn of the multi-layer film, so that it takes a large number of these turns to absorb substantially all of this energy from the source 11.

It is to be understood that this invention may have a structural form different from the spiral-wound film that forms a cylinder in the disclosed embodiment. The composition and thickness of each electrically conductive layer and each intermediate layer in the cell may differ from the specific example given, so long as each layer is capable of performing its intended function. If desired, the retarding layer R may be omitted, leaving the film as a five-layer body made up of electrically conductive emitter and collector layers, a first intermediate insulating layer 12 and a second intermediate layer C' of a material with a substantial Compton effect sandwiched between them, and an insulation layer on the other side of the collector layer. However, in any such modified embodiment it is crucially important that each insulation layer (e.g., 12 and 13) between an radiation-absorbing layer and a charge-collecting layer be within the 50 Angstroms–500 microns range of thickness so that a relatively large number of secondary Compton electrons will have enough kinetic energy to reach the charge-collecting layer, so their charges are added to the charges of the photoelectrons released from the radiation-absorbing layer, as described.

I claim:

1. In a power cell for generating electrical power from high frequency electromagnetic energy having a known direction of radiation, a multi-layer film comprising:

first and second electrically conductive layers spaced apart in succession in said direction and first and second intermediate layers sandwiched between said first and second electrically conductive layers;

said first electrically conductive layer being capable of emitting photoelectrons into said first intermediate layer generally in said direction when subjected to said electromagnetic energy;

said first intermediate layer being of insulating material and having a thickness substantially within the range from 50 Angstroms to 500 microns, said first intermediate layer being capable of producing secondary Compton electrons moving generally in said direction in response to the movement of said photoelectrons from said first electrically conductive layer through said first intermediate layer;

said second intermediate layer being of a material having a substantial Compton effect for producing secondary Compton electrons moving generally in said direction in response to the movement of said photoelectrons from said first electrically conductive layer through said second intermediate layer;

and said second electrically conductive layer being capable of receiving the charges of said photoelectrons and said secondary Compton electrons arriving at said second electrically conductive layer.

2. A power cell according to claim 1 wherein said multi-layer film also comprises:

a third electrically conductive layer on the opposite side of said second electrically conductive layer from said first electrically conductive layer;

and a third intermediate layer of insulating material sandwiched between said second and third electrically conductive layers, said third intermediate layer having a substantially greater thickness than said first intermediate layer but within said 50 Angstroms–500 microns range;

said second electrically conductive layer being capable of emitting photoelectrons into said third intermediate layer generally in said direction in response to said electromagnetic energy;

said third intermediate layer being capable of producing secondary Compton electrons moving generally in said direction in response to the movement of said photoelectrons from said second electrically conductive layer through said third intermediate layer;

and said third electrically conductive layer being capable of receiving the charges of said photoelectrons from said second electrically conductive layer and said secondary Compton electrons from said third intermediate layer arriving at said third electrically conductive layer.

3. In combination, a power cell according to claim 2;

and a bleeder regulator connected across said third and second electrically conductive layers for passing charge current from said third electrically conductive layer to said second electrically conductive layer.

4. The combination of claim 3 wherein said bleeder regulator comprises voltage regulator means operable when the voltage difference between said third and second electrically conductive layers exceeds a predetermined value to conduct said charge current from said third to said second electrically conductive layer.

5. A power cell according to claim 2 wherein said multi-layer film also comprises:

an additional layer of dielectric material engaging the opposite of said third electrically conductive layer from said third intermediate layer.

6. A power cell according to claim 5 wherein said multi-layer film is spirally wound in a multiplicity of contiguous turns to form a substantially cylindrical body with an axial opening therein for receiving a spent nuclear reactor fuel rod as the source of said high frequency electromagnetic radiation.

7. In combination, a power cell according to claim 6;

and a blender regulator connected across said third and second electrically conductive layers for conducting excess charge on said third electrically conductive layer to said second electrically conductive layer.

8. The combination of claim 7 wherein said bleeder regulator comprises voltage regulator means operable when the voltage difference between said third and second electrically conductive layers exceeds a predetermined value to conduct said excess charge from said third to said second electrically conductive layer.

9. The combination of claim 8 wherein said power cell also comprises:

a ground anode on the outside of said substantially cylindrical body connected conductively to said first electrically conductive layer;

and a cathode on the outside of said body connected conductively to said second electrically conductive layer.

* * * * *